US005329498A

United States Patent [19]

Greenstein

[11] Patent Number: 5,329,498

[45] Date of Patent: Jul. 12, 1994

[54] SIGNAL CONDITIONING AND INTERCONNECTION FOR AN ACOUSTIC TRANSDUCER

[75] Inventor: Michael Greenstein, Los Altos, Calif.

[73] Assignee: Hewlett-Packard Company, Palo Alto, Calif.

[21] Appl. No.: 62,665

[22] Filed: May 17, 1993

[51] Int. Cl.[5] ..... H04R 17/00

[52] U.S. Cl. ..... 367/155; 310/327; 310/334

[58] Field of Search ..... 367/135, 155, 153, 162, 367/176; 310/327, 334, 335; 29/594

[56] References Cited

U.S. PATENT DOCUMENTS

| | | | |
|---|---|---|---|
| 3,979,711 | 9/1976 | Maginness et al. | 367/155 |
| 4,672,737 | 6/1987 | Carson et al. | 29/572 |
| 4,706,166 | 11/1987 | Go | 361/403 |
| 4,714,846 | 12/1987 | Pesque et al. | 310/317 |
| 4,825,115 | 4/1989 | Kawabe et al. | 310/327 |
| 4,866,683 | 9/1989 | Phillips | 367/157 |
| 4,890,268 | 12/1989 | Smith et al. | 367/138 |
| 5,187,403 | 2/1993 | Larson, III | 310/334 |

FOREIGN PATENT DOCUMENTS

| | | | |
|---|---|---|---|
| 1530783 | 11/1978 | United Kingdom | 310/334 |

OTHER PUBLICATIONS

"Real Time Imaging of Internal Body Structures," *Ultrasonics*, vol. 12, Nov. 1974.

*Primary Examiner*—Ian J. Lobo

[57] ABSTRACT

An ultrasonic device having an acoustic transducer with a lamination of parallel integrated circuit chips having active circuitry. A backing member made of a material for attenuating acoustic waves provides Z-axis conduction of signals from the parallel integrated circuit chips to individual piezoelectric elements. Preferably, each piezoelectric element is operatively associated with a particular circuit that is within the acoustic shadow of the element, so that the lamination of chips does not add to the cross sectional area of the transducer. The integrated circuit chips are coterminus at first edges to provide a planar contact surface having a pad grid array of contact pads for connection with conductors extending through the backing member. In one embodiment, the piezoelectric elements provide a two-dimensional array of elements that corresponds to the pad grid array. Circuitry on the integrated circuit chips can include protective diodes, preamplifiers and one or more multiplexers.

19 Claims, 8 Drawing Sheets

SIGNAL CONDITIONING AND INTERCONNECTION FOR AN ACOUSTIC TRANSDUCER

DESCRIPTION

1. Technical Field

The present invention relates generally to acoustic transducers and more particularly to signal conditioning and interconnecting schemes for ultrasonic transducer arrays.

2. Background Art

A diagnostic ultrasonic imaging system for medical use forms images of tissues of a human body by electrically exciting an acoustic transducer element or an array of acoustic transducer elements to generate short ultrasonic pulses that are caused to travel into the body. Echoes from the tissues are received by the acoustic transducer element or elements and are converted into electrical signals. The electrical signals are amplified and used to form a cross sectional image of the tissues. Echographic examination is also used outside of the medical field.

Two areas of concern in the fabrication of ultrasonic imaging systems are the means for achieving electrical interconnections and the means for conditioning signals. Regarding signal conditioning, circuitry for preamplification, protection and control is ideally located on-board the transducer head that is brought into contact with the human body or other object of interest. However, the transducer head should be a compact, lightweight device that is easily manipulated. Including preamplification and protection circuitry for each transducer element of a two-dimensional array of elements is not easily accomplished.

Electrical interconnections of components within the transducer head are complicated by the presence of a backing layer. The individual transducer elements acoustically convert input signals to wave energy that is directed both forwardly and rearwardly. An energy absorptive backing layer prevents reflections of the rearwardly directed energy from reducing the ultrasonic image resolution. While the reflections would improve the power output of the system, the reflections would widen the acoustic output pulses, thereby adversely affecting resolution.

The backing layer does not present problems to electrical interconnections within transducer heads having a single element. However, the interconnection scheme becomes an important concern for linear arrays of transducer elements. The concern is increased for transducer heads having two-dimensional arrays of more than three rows and columns of elements, since many of the elements will not have an exposed edge that accommodates electrical connection.

U.S. Pat. No. 4,825,115 to Kawabe et al. describes a method of providing excitation energy to a center column of elements. Bonding wires may be attached to the center elements, whereafter the backing layer is formed using molding techniques. As noted in the patent, the difficulty with this interconnection scheme is that as the distance between the transducer elements is reduced in order to improve resolution, the potential of two bonding wires shorting together is also increased. Kawabe et al. teaches that a preferred interconnection scheme is one that uses L-shaped printed wiring boards having first legs that contact the transducer elements and second legs that extend rearwardly along the spacings between adjacent columns of elements. The backing layer is molded between the second legs of the L-shaped printed wiring boards. While Kawabe et al. provides a significant improvement over prior interconnection schemes, the first legs of the printed wiring board remain in contact with the transducer elements, so as to provide a surface for reflecting wave energy.

It is an object of the present invention to provide a compact, lightweight acoustic transducer that allows signal conditioning for individual transducer elements in an array of elements and that includes an interconnection scheme that effectively attenuates rearwardly directed wave energy.

SUMMARY OF THE INVENTION

The above object has been met by an acoustic transducer having an array of piezoelectric elements that are individually driven by circuitry contained on a lamination of parallel integrated circuit chips. The lamination of chips is on a side of a backing member that provides acoustic attenuation of the portion of wave energy that is directed rearwardly from the piezoelectric elements. In a preferred embodiment, the backing member provides electrical contact from the individual piezoelectric elements to the integrated circuit chips, but isolates adjacent piezoelectric elements. That is, the backing member preferably is a Z-axis electrical conductor.

The acoustic transducer may have a linear array of piezoelectric elements, but typically the elements are arranged two-dimensionally. A two-dimensional array will have MxN piezoelectric elements, with M elements in an azimuthal direction and N elements in an elevational direction. The integrated circuit chips may each extend in the azimuthal direction, with the number of chips having active circuitry corresponding to the number of elements (M) in the elevational direction. Thus, each integrated circuit chip may be dedicated to one row of elements and may be fixed directly behind the row to which it is dedicated.

Preferably, each piezoelectric element is driven by a separate integrated circuit, with each circuit being directly behind the element to be driven. Because the backing member absorbs acoustic wave energy from the elements before the energy reaches the lamination of integrated circuit chips, the individual circuits are within the "acoustic shadow" of the specific element to be driven. As a result, the on-board circuitry does not adversely affect the acoustic properties of the transducer and does not add to the cross sectional area of the transducer.

The lamination of integrated circuit chips is formed by fabricating individual semiconductor circuits that are protected by a passivation layer and then bonding the chips to form a block. The chips may be laminated using thermal bonding, pressure or fastening members, but typically an adhesive is employed. Preferably, the chips are coterminus at first edges, so as to form a contact surface. A pad grid array of transducer pads is formed on the contact surface. This pad grid array provides access to conductors from the individual piezoelectric elements.

The integrated circuit chips may also be coterminus at edges opposite to the pad grid array at the first edges. In this embodiment, a second pad grid array may be formed for contact with a cable through which signals are transmitted to and from remote electronic circuitry. Alternatively, the second edges may be non-coterminus, exposing input/output pads to be connected to such a cable.

Electrical communication between the integrated circuit chips and the piezoelectric elements may be achieved by extending conductors through the backing member. For example, the backing member may be a block of acoustical attenuating material having embedded cylindrical conductors that terminate at opposed ends of the backing member to provide first exposed ends that are arranged to correspond to the pad grid array of the laminated chips and to provide second exposed ends corresponding to the positions of the piezoelectric elements. Alternatively, the backing member may be a laminated member having alternating layers of attenuating material and strips of electrically conductive material. The shape of the backing member is not critical.

An advantage of the present invention is that onboard circuitry for conditioning input and output signals can be provided using the lamination of integrated circuit chips without a significant increase in the size of the device that is to be manipulated by a user. The laminated chips include circuitry that is within the acoustic shadows of the piezoelectric elements. The semiconductor chips allow the problem of signal conditioning to be partitioned into modular subassemblies, with each subassembly responsible to a manageable task. Another advantage is that the use of pad grid arrays of contact sites provides a reliable interconnection scheme that does not adversely affect the acoustic properties of the transducer. In fact, wires having high acoustic impedance may be employed to aid in properly attenuating acoustic wave energy transmitted from the rearward faces of the piezoelectric elements. The invention is particularly suited to two-dimensional arrays having a short center-to-center spacing, e.g., 300 μm, but may also be used for one-dimensional arrays.

BEST MODE FOR CARRYING OUT THE INVENTION

Figure 1:
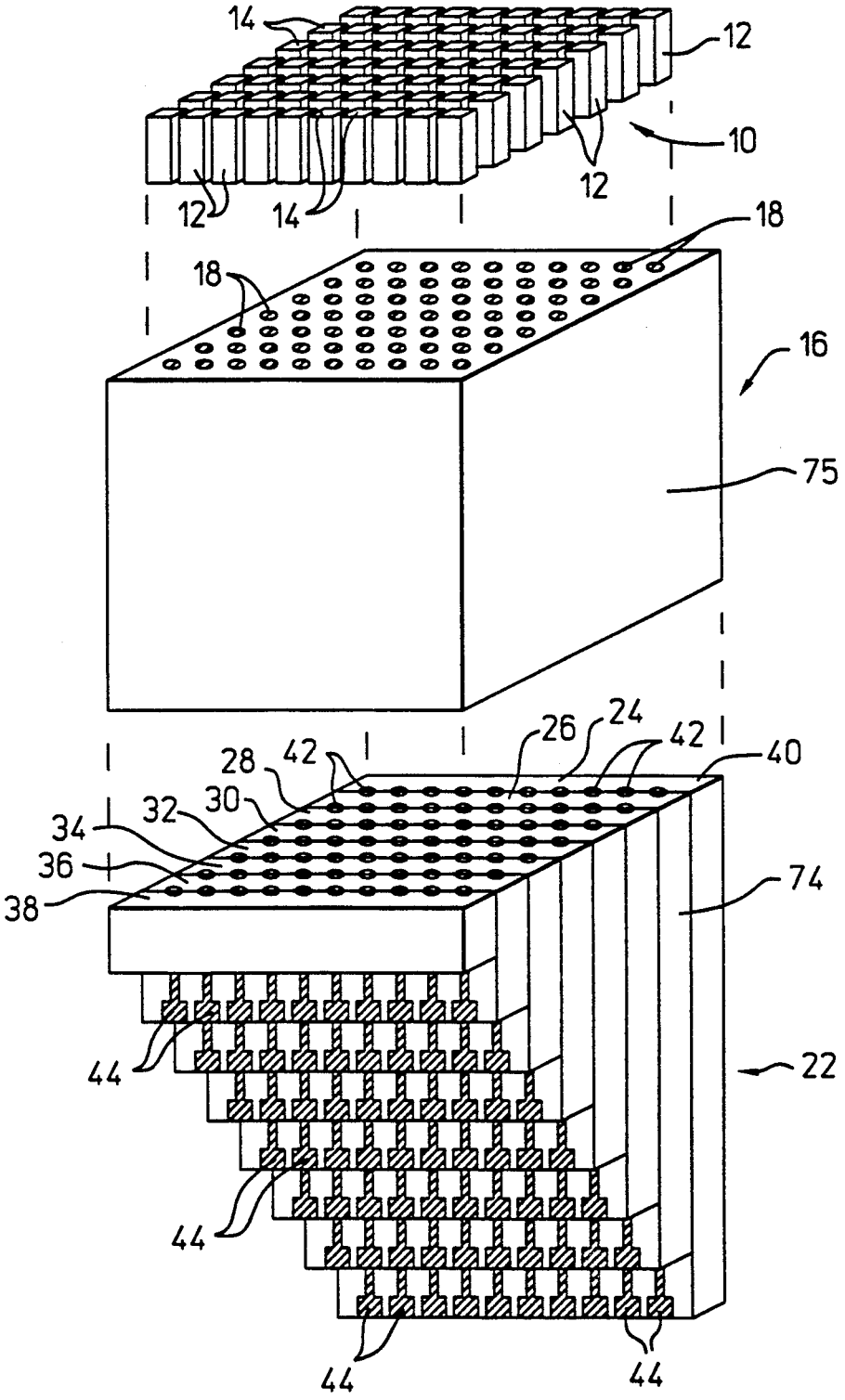
FIG. 1 is an exploded perspective view of a two-dimensional acoustic transducer in accordance with the present invention.

With reference to FIG. 1, a two-dimensional transducer array 10 is shown as including ten piezoelectric elements 12 in an azimuthal direction and seven elements in an elevational direction. "Piezoelectric" is defined as any material that generates mechanical waves in response to an electrical field applied across the material. Piezoelectric ceramics and polymers are known.

Ideally, the seventy piezoelectric elements 12 are individually controlled. Individual control allows electronic focusing of the acoustic transducer 10. Two-dimensional arrays can be phased by delaying signals to selected elements 12, so as to achieve a desired direction and focal range. Electronically focused transducer arrays offer the advantage that they can be held stationary during an echographic examination, potentially increasing the resolution and the useful life of the transducers.

The piezoelectric elements 12 may be formed by dicing or patterning a lead zirconium titanate (PZT) rectangular block using conventional techniques. Current technology enables formation of a two-dimensional array 10 having an element pitch of 300 μm. Excitation of the piezoelectric elements 12 causes acoustic wave energy to be transmitted from forward faces 14 of the elements. Drive signals are controlled to allow reflected wave energy to be received at the forward faces. An electrical signal is formed in response to the received energy. Electronics remote from the transducer array 10 monitor the received signals and form an image of the body that reflected the acoustic wave energy.

Exciting the piezoelectric elements 12 transmits acoustic wave energy from the rearward faces, as well as from the forward faces 14. An impedance mismatch at the rearward faces will cause reflections to the forward faces. While such acoustic reflections will improve the power output of the array 10, the resulting increase in the width of the output pulses will lead to poor ultrasonic image resolution. Consequently, a backing member 16 is employed with the present invention. In the embodiment of FIG. 1, the backing member is a block of acoustical energy attenuating material. For example, the backing member may be formed of an epoxy material having acoustic absorbers and scatterers such as tungsten particles and silica particles or air bubbles.

In addition to attenuating acoustic wave energy from the piezoelectric elements 12, the backing member 16 functions as a Z-axis electrical conductor. That is, conductors 18 are embedded to extend through the backing member in parallel fashion. The ends of conductors 18 are exposed at the top surface 20 shown in FIG. 1 and are also exposed at the bottom surface, not shown.

The transducer array 10 and the backing member 16 may then be assembled with the conductors 18 in physical and electrical contact with contacts, not shown, on the rearward faces of the piezoelectric elements 12. In practice, the block of piezoelectric material that is diced or patterned to form the matrix of elements should be connected to the backing member before the piezoelectric elements are separated. An epoxy or other suitable adhesive may be applied to one or both of the surfaces to be brought together.

After assembly of the solid block of piezoelectric material to the backing member 16, the block of piezoelectric material may be diced or patterned to form the individual piezoelectric elements 12. For example, a diamond saw may be employed to cut into the piezoelectric material. The separation preferably includes forming kerfs through the material used for bonding and into the backing member 16. These kerfs aid in acoustically electrically isolating adjacent elements.

Optionally, the selection of materials for forming the conductors 18 considers acoustic properties, as well as electrical properties. An impedance match between the conductors 18 and the backing member 16 would allow flow of acoustic wave energy from the conductors to the backing member. However, such a transfer of energy may not be sufficient to draw the desired degree of acoustic energy from the conductors. To increase the efficiency of the transfer, the acoustic velocity of the conductors should be greater than the acoustic velocity of the backing member 16. Such a structure would cause the conductors and backing member to function as a reverse wave guide. Suitable materials to achieve the desired acoustic velocity mismatch include copper and steel. Still greater efficiency of the transfer of energy from the conductors can be achieved by coating the conductors with aluminum or some other material having a lower acoustic velocity than the conductors.

As an alternative to providing a backing layer 16 that is preformed to include the conductors 18, the conductors may be first attached to the contact areas on the rearward side of a solid block of piezoelectric material, and the acoustical attenuating material may then be molded about the conductors to achieve a Z-axis connector. A problem with such an approach, as well as the approach illustrated in FIG. 1, is that as the density of piezoelectric elements 12 increases, the potential of shorting between adjacent conductors also increases.

Another alternative is to provide a laminated backing member, with alternating layers of acoustical attenuating material and electrically conductive material. The conductive layers should be divided into strips of material having a pitch equal to the pitch of the piezoelectric elements to be driven. For example, the pitch of the conductive strips of a single layer may be 300 μm, wherein the strips have a width of 250 μm and are separated by a kerf of 50 μm. A suitable thickness may be 3000 Å. Such a strip having a length of 15 mm was measured to have a resistance of approximately 1 ohm.

For the laminated backing members, the thickness of the attenuating layers should be equal to the pitch of the piezoelectric elements. The conductive and the attenuating layers can be bonded using a standard low viscosity epoxy. The lamination may include dummy layers to act as spacers. The resulting structure should be lapped or otherwise treated to obtain a clean surface finish having no steps that would result from the lamination process.

The resulting laminated backing member could then be coated with a metallization layer on top and bottom edges. Patterning of the metallization layer would provide contact sites having a sufficient area to reliably connect to adjoining surfaces, such as contacts on the rearward faces of piezoelectric elements. Patterning the metallization layer on a surface may be achieved using conventional photolithographic techniques. However, a self-aligning process can be achieved by allowing electrical contact of all of the contact sites until kerfs are made during diamond sawing of piezoelectric material and the top surface of the backing member when the piezoelectric elements are formed.

Yet another alternative is to utilize Z-axis material for the formation of the backing member. Z-axis epoxy is known. Such an epoxy would eliminate the requirement of separate conductors, since filler material within the epoxy itself would allow electrical conduction in one direction, but would achieve electrical isolation in all other directions. The difficulty is the choice of a Z-axis material that provides sufficient acoustical attenuation.

Mechanically and electrically connected to the backing member 16 is a lamination of integrated circuit chips 22. The lamination 22 includes seven active semiconductor chips 24, 26, 28, 30, 32, 34 and 36. A spacer chip 38 is used at one end of the lamination.

First edges of the chips 24–38 are coterminus to provide a planar interconnect surface 40. Along the interconnect surface is a pad grid array of contact pads 42. The pattern of the contact pads corresponds to the pattern of conductors 18 through the backing member 16. The contact pads are electrically connected to the piezoelectric elements 12 when the lamination 22 of integrated chips is bonded to the backing member. An epoxy or other suitable adhesive may be employed to bond the various components together. The contact pads 42 are raised areas, so that physical and electrical contact to the backside of the conductors 18 is possible even in the presence of a thin adhesive layer between the lamination 22 and the backing member 16. Alternatively, the acoustic transducer array 10, the backing member and the lamination of integrated circuit chips may be held together by pressure.

The semiconductor chips 24-36 vary in length so that input/output pads 44 are exposed at edges opposite to the interconnect surface 40. Each of the active semiconductor chips 24–36 can be divided into parallel cells, with each cell having a circuit for driving a piezoelectric element 12. Thus, the lamination 22 of chips is a three-dimensional semiconductor circuit that is fabricated from a laminated set of chips that each contain a set of circuits. In FIG. 1, the number of active chips corresponds to the number of piezoelectric elements 12 in the elevational direction. Each of the seven chips can then be divided into ten cells to allow a one-to-one correspondence of cells to piezoelectric elements 12 in the azimuthal direction.

Figure 2:
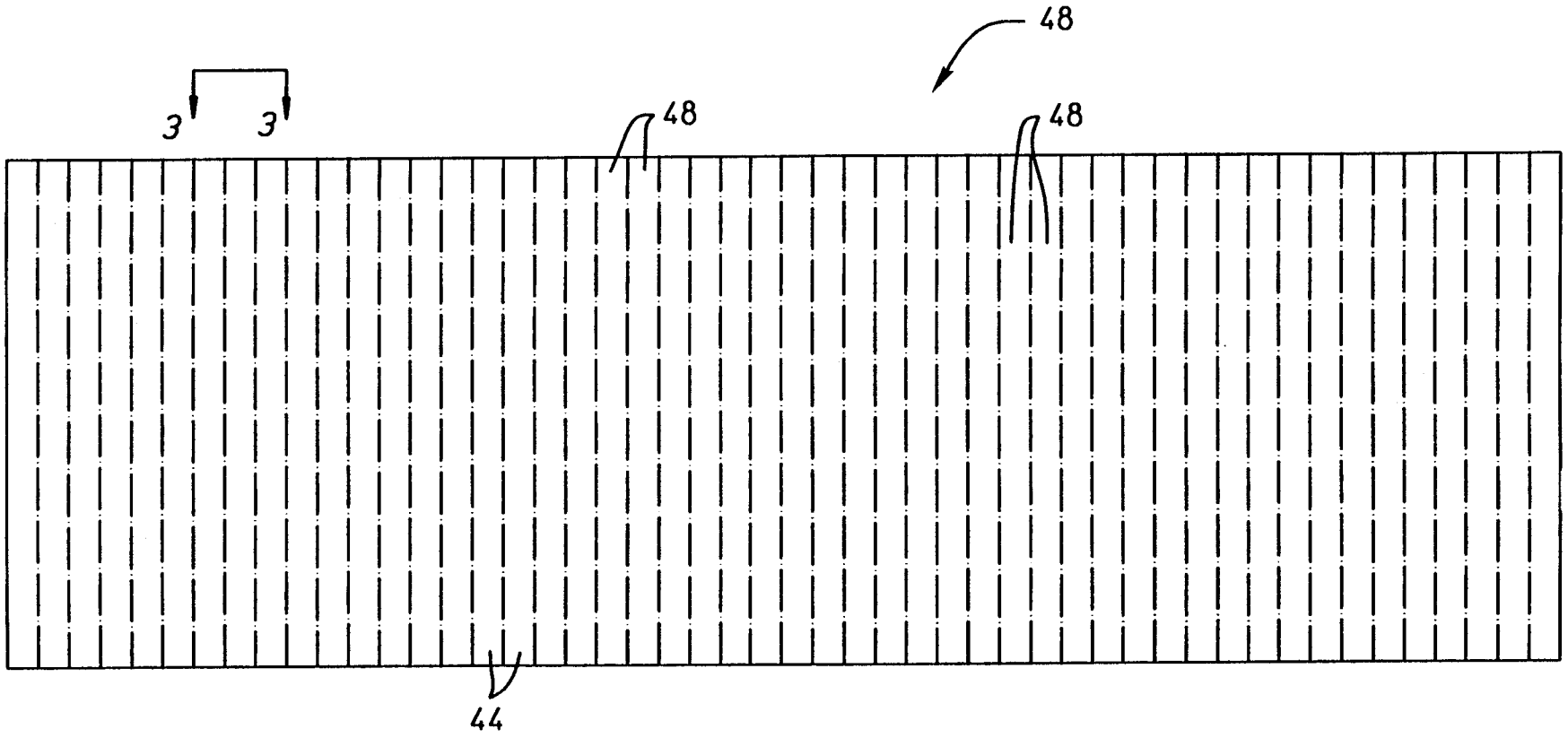
FIG. 2 is a side view of an active integrated circuit chip of FIG. 1.

Referring now to FIG. 2, a single silicon chip 46 is shown divided into fifty unit cells 48. The chip 46 may be used with a 50x50 array of piezoelectric elements. Each unit cell may include preamplifiers, protection diodes and limited integrated control electronics for driving individual piezoelectric elements in the array.

Figure 3:
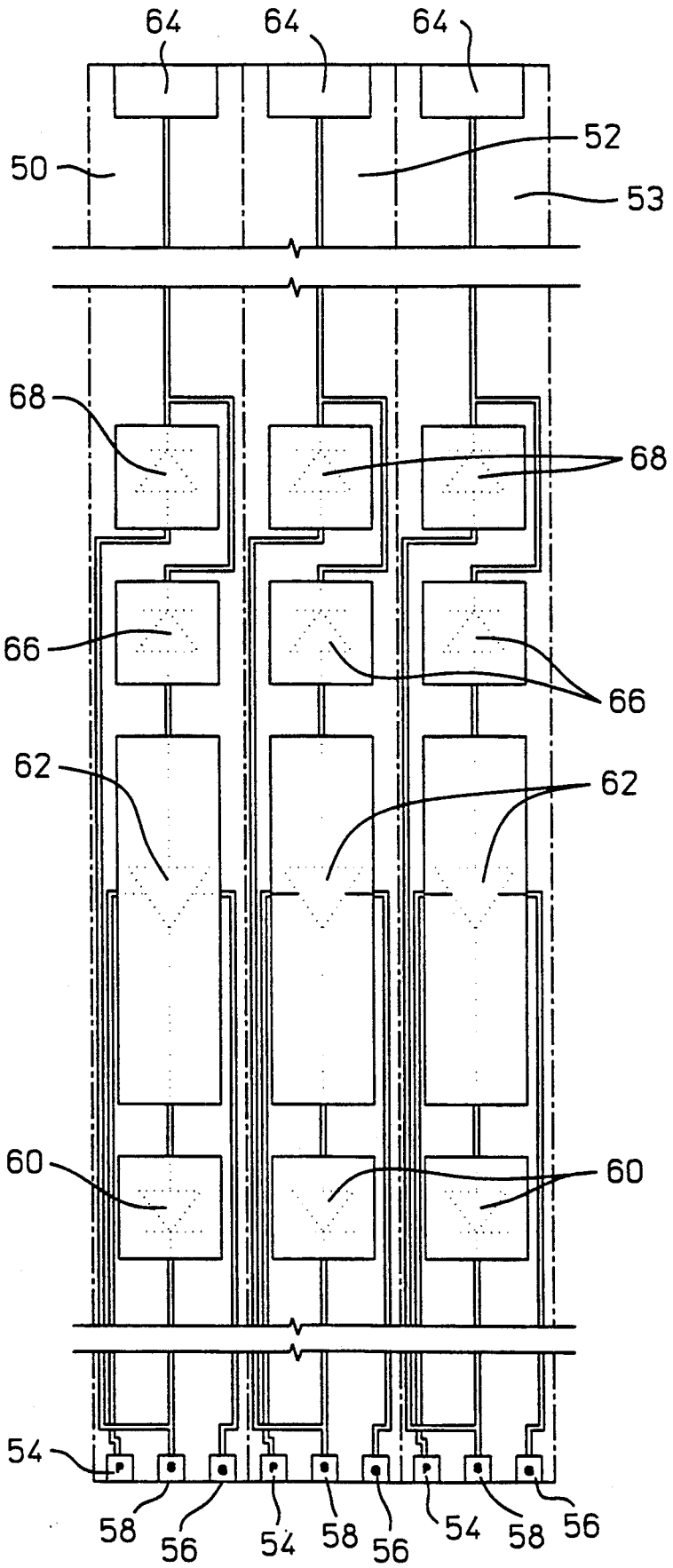
FIG. 3 is a side view of circuitry within three cells of the integrated circuit chip of FIG. 2, taken along lines 3—3.

Referring now to FIG. 3, three adjacent unit cells 50, 52 and 53 are shown having circuitry fabricated within the cells. The circuitry of each cell is shown schematically in FIG. 4. The cells 50–53 may be from any one of the active semiconductor chips 24–36 of FIG. 1 or from the silicon chip 46 of FIG. 2.

Each unit cell 50–53 includes a power pad 54, a ground pad 56 and a signal pad 58. A preamp output protection diode (D1) 60 protects a preamplifier 62 from transmit pulses that enter at the associated signal pad 58. The preamplifier 62 functions to amplify signals received from a transducer pad 64 at the edge of the chip that is opposite to the pads 54–58. The preamplifier is important to enabling the acoustic device to drive a cable that is connected at the power, ground and signal pads 54–58.

A preamp input protection diode (D2) 66 protects the preamplifier input circuitry from transmit pulses. A cable isolation diode (D3) 68 acts to protect the operatively associated piezoelectric transducer element from the requirement of driving the capacitance of the cable. Bias resistors (R1, R2, R3 and R4) 70, 71, 72 and 73 are located within the preamplifier 62 to properly bias the diodes.

The unit cells of FIGS. 2 and 3 may have a pitch of 300 μm using known semiconductor fabrication techniques. Typical unit cells range from 5 mm to 25 mm in length. Depending upon the length, crosstalk may be a concern, but coplanar shielding can be incorporated in order to reduce the likelihood of crosstalk.

Figure 4:
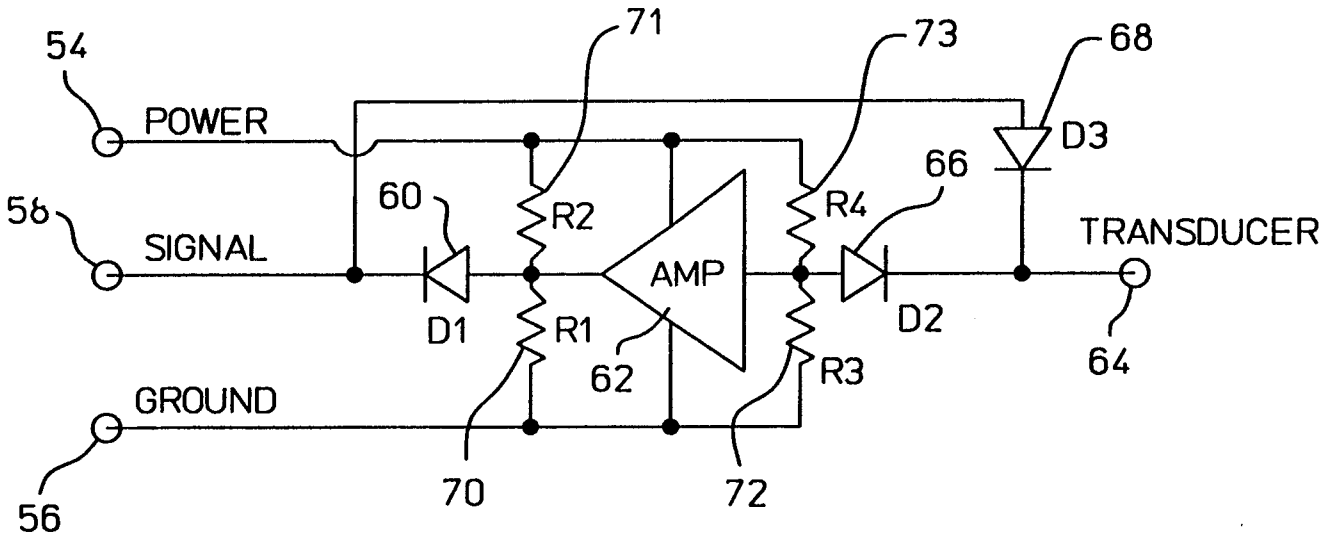
FIG. 4 is a schematic view of a circuit of FIG. 3.

The circuit of FIGS. 3 and 4 is included as being only an example of on-board circuitry and is not intended to limit the present invention. In practice, a full cycle may include a transmit pulse from 0 to 100 volts and back to 0 volts, followed by a drop to −100 volts and a return to 0 volts. The described circuit would work adequately for a positive pulse, but a bipolar transmit pulse that includes the drop to −100 volts would require the protective diodes to be doubled in number.

The circuit can be fabricated within the cells 50–53 using standard photolithographical techniques. The seven active semiconductor chips 24–36 of FIG. 1 can be fabricated from a single silicon wafer that is then diced to separate the chips. A passivation layer on the patterned chips protects the circuit.

Figure 5:
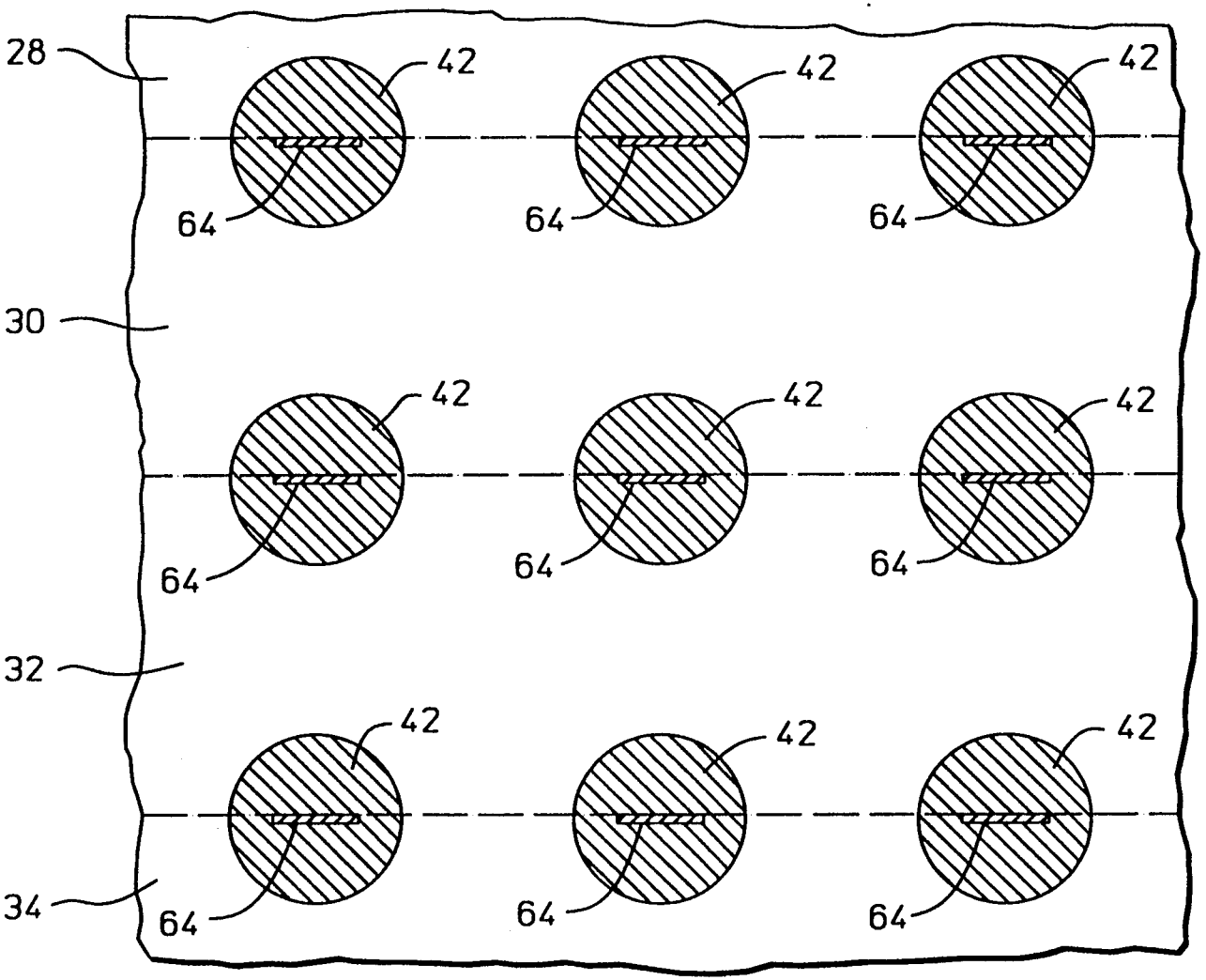
FIG. 5 is a top view of a portion of the pad grid array on the lamination of integrated circuit chips of FIG. 1.

The seven active semiconductor chips 24–36 and the spacer semiconductor chip 38 are then adhesively joined to form the block shown in FIG. 1. Commercially available adhesives may be utilized. The lamination of the integrated circuit chips 22 is then lapped at the interconnect surface 40 to planarize the interconnect surface. A metallization layer is formed on the interconnect surface and the sides 74 of the array of chips. The metallization on the sides is grounded to provide a ground plane. The metallization on the interconnect surface 40 is utilized to ensure a proper connection between the contact pads 42 and the conductors 18 of the backing member 16. The metallization layer at this interconnect surface 40 is patterned to provide the circular members of FIG. 5. This figure illustrates contact pads 42 that are patterned from a gold layer. The patterned contact pads 42 are aligned with transducer pads 64 as described with reference to FIG. 3. The contact pads are not critical, but the increase in contact surface area that is provided by the pads 42 allows a relaxation of manufacturing tolerances in laminating the integrated circuit chips and in connecting the chips to the conductors of the backing member.

Returning to FIG. 1, while not shown, the acoustic transducer may have a personality layer between the backing member 16 and the lamination 22 of the integrated circuit chips. A personality layer may be used to modify the interconnect of the pattern of contact pads 42 to the pattern of conductors 18 or to mate a stepped rearward face of a backing member 16 to the planar interconnect surface 40. The personality layer can be made of silicon having conductive traces on one or both sides and having plated throughholes extending from one side to the opposite side. The personality layer would be positioned perpendicular to the active semiconductor chips 24–36.

Figure 6:
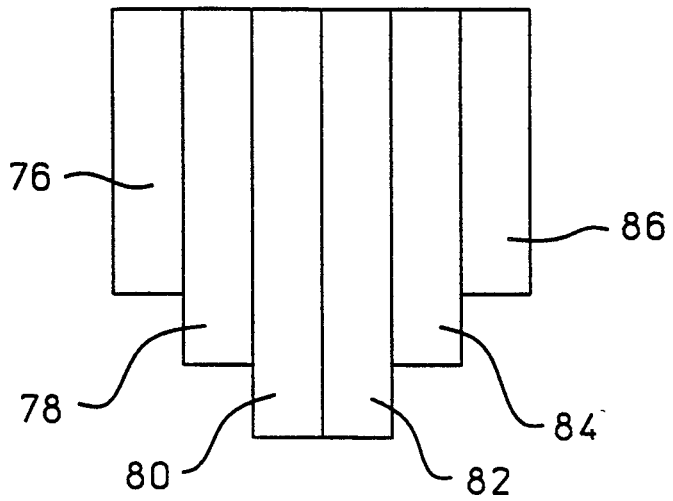
FIG. 6 is a side view of a second embodiment of a lamination of integrated circuit chips in accordance with the present invention.

The lamination 22 of chips 24–38 is illustrated in FIG. 1 as having an inverted staircase configuration. However, this is not critical. A symmetrical configuration is shown in FIG. 6. Six active semiconductor chips 76, 78, 80, 82, 84 and 86 are shown. The integrated circuitry may be on the right sides of chips 32, 34 and 36 and on the left side of chips 76, 78 and 80. Optionally, a double-sided silicon chip may be utilized for one of the center chips 80 and 82.

Figure 7:
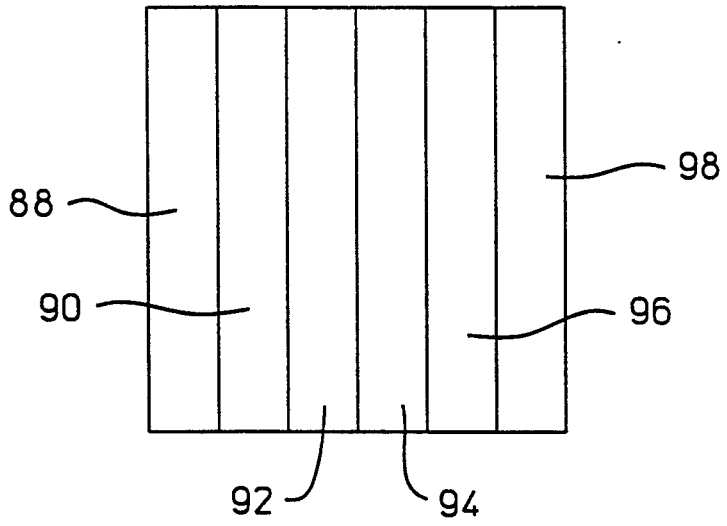
FIG. 7 is a side view of a third embodiment of the lamination of integrated circuit chips in accordance with the present invention.

FIG. 7 illustrates a square lamination of integrated circuit chips 88, 90, 92, 94, 96 and 98. Again, the chips 94–98 that are on the right side of the center may have integrated circuits on the surface to the right, while chips 88, 90 and 92 have integrated circuits on surfaces to the left. As in FIG. 6, the square configuration would leave a blank interconnect area at the center if a double-sided wafer is not employed. In the embodiment of FIG. 7, a pad grid array is presented at the opposed sides. One side connects to a backing member, while the opposite side connects to a flex circuit that attaches to a cable. Alternatively, the cable may have a termination scheme that allows connection directly to the pad grid array.

In operation, the lamination 22 of integrated circuit chips in FIG. 1 is coupled to a cable to receive and transmit signals at the input/output pads 44. Contact pads 42 are patterned to align with conductors 18 on the backing member 16. Signal conditioning is provided by circuitry on each of the active semiconductor chips 24–36. Both the lamination of chips and the backing member 16 include ground planes at sides 74 and 75. The ground planes are designed to reduce the likelihood of crosstalk.

Transmit pulses that are inputted at the pads 44 are acoustically converted at the piezoelectric elements 12. Wave energy is transmitted from the forward faces 14 of the elements 12. The energy transmitted from the forward faces is utilized to achieve echographic examination.

The undesirable transmission of acoustic wave energy from the rearward faces of the piezoelectric elements 12 is absorbed by the backing member 16 made out of a material selected to attenuate the energy. As noted above, the efficiency of the acoustic attenuation can be increased by the selection of material for forming the conductors 18.

Reflected wave energy received at the forward faces 14 of the piezoelectric elements 12 is converted to an electrical signal that is conducted to the active semiconductor chips 24–36 by the conductors 18 of the backing member 16. This receive signal is conditioned by the circuitry on the chips. For example, receive signals may be separately amplified by preamplifiers fabricated on the active chips 24–36.

The circuitry for conditioning signals for each of the piezoelectric elements 12 may be in the "acoustic shadow" of the particular piezoelectric element. That is, the circuitry associated with each piezoelectric element may be directly rearward of the element and on a side of the backing member 16 opposite to the piezoelectric element. Thus, any acoustic energy transmitted from a rearward face of a piezoelectric element will be attenuated prior to reaching the integrated circuit. Perhaps more importantly, the inclusion of on-board circuits does not add to the cross sectional area of the device. This allows the device to be easily manipulated by a user.

While the invention has been described as being applied to two-dimensional acoustic arrays, laminated integrated circuit chips may also be used with one-dimensional arrays. Such arrays are also referred to as linear arrays. Thus, on-board preamps or other electronics may be provided for use with conventional linear arrays. The application of laminated integrated circuit chips then depends on the relationship of the pitch of the piezoelectric elements to the pitch of the circuits on the chips.

Figure 8:
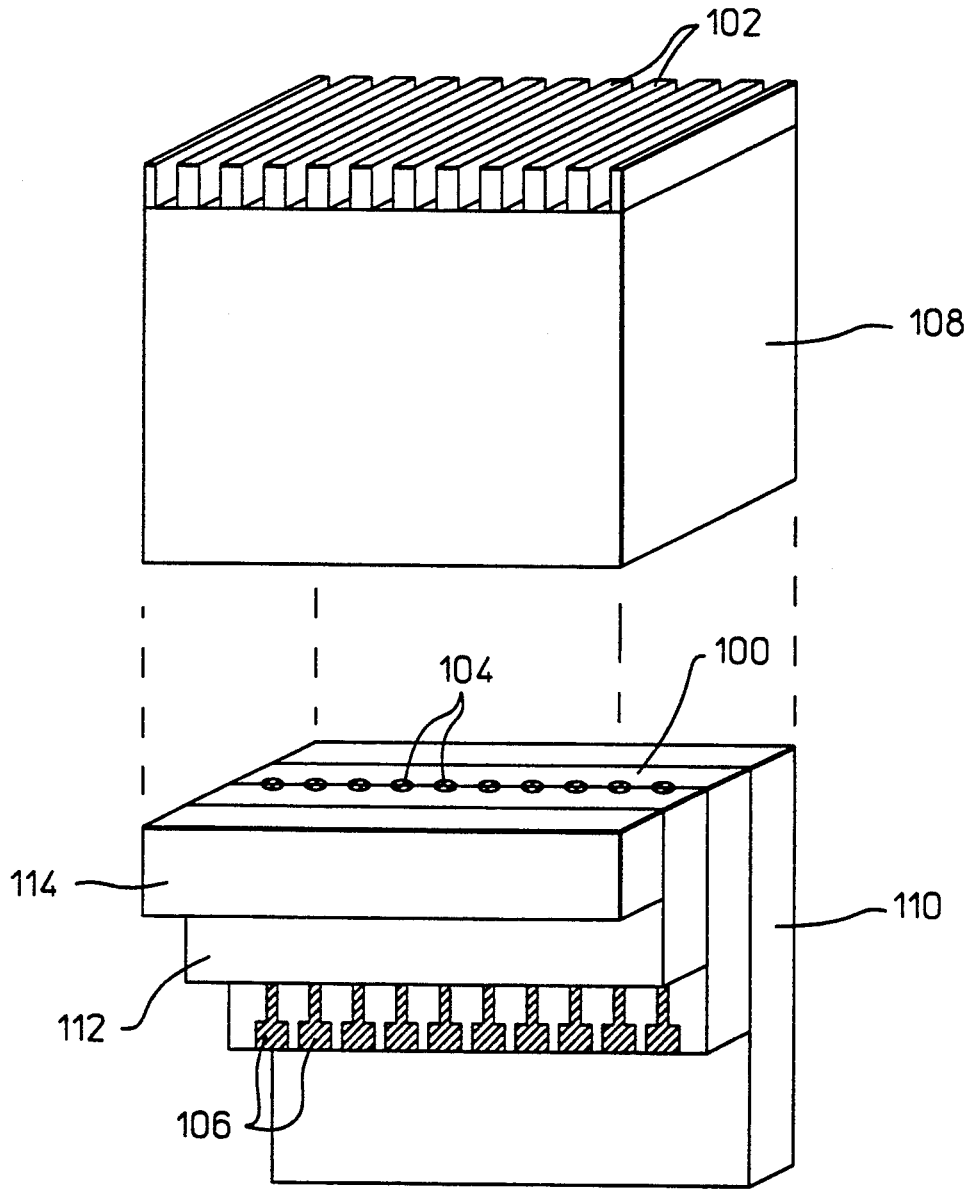
FIG. 8 is another embodiment of the acoustic transducer of FIG. 1.

For example, in FIG. 8 the pitch of the circuits on an active integrated circuit chip 100 is less than or equal to the pitch of the piezoelectric elements 102, so that a one-dimensional pad grid array of contact pads 104 is sufficient. Input/output pads 106 extend rearwardly from the active integrated circuit chip 100 for contact with a flex cable, not shown. Transmit pulses from the cable enter at the pads 106. The transmit pulses are conducted to the contact pads 104 to be channeled to the individual piezoelectric elements 102 via conductors extending through a Z-axis backing member 108. The active integrated circuit chip 100 is bonded to spacer chips 110, 112 and 114 to match the dimensions of the backing member 108. Both the backing member and the lamination of chips include ground planes on exposed sides. Received signals undergo conditioning at circuits on the active chip 100 in the same manner described above.

Figure 9:
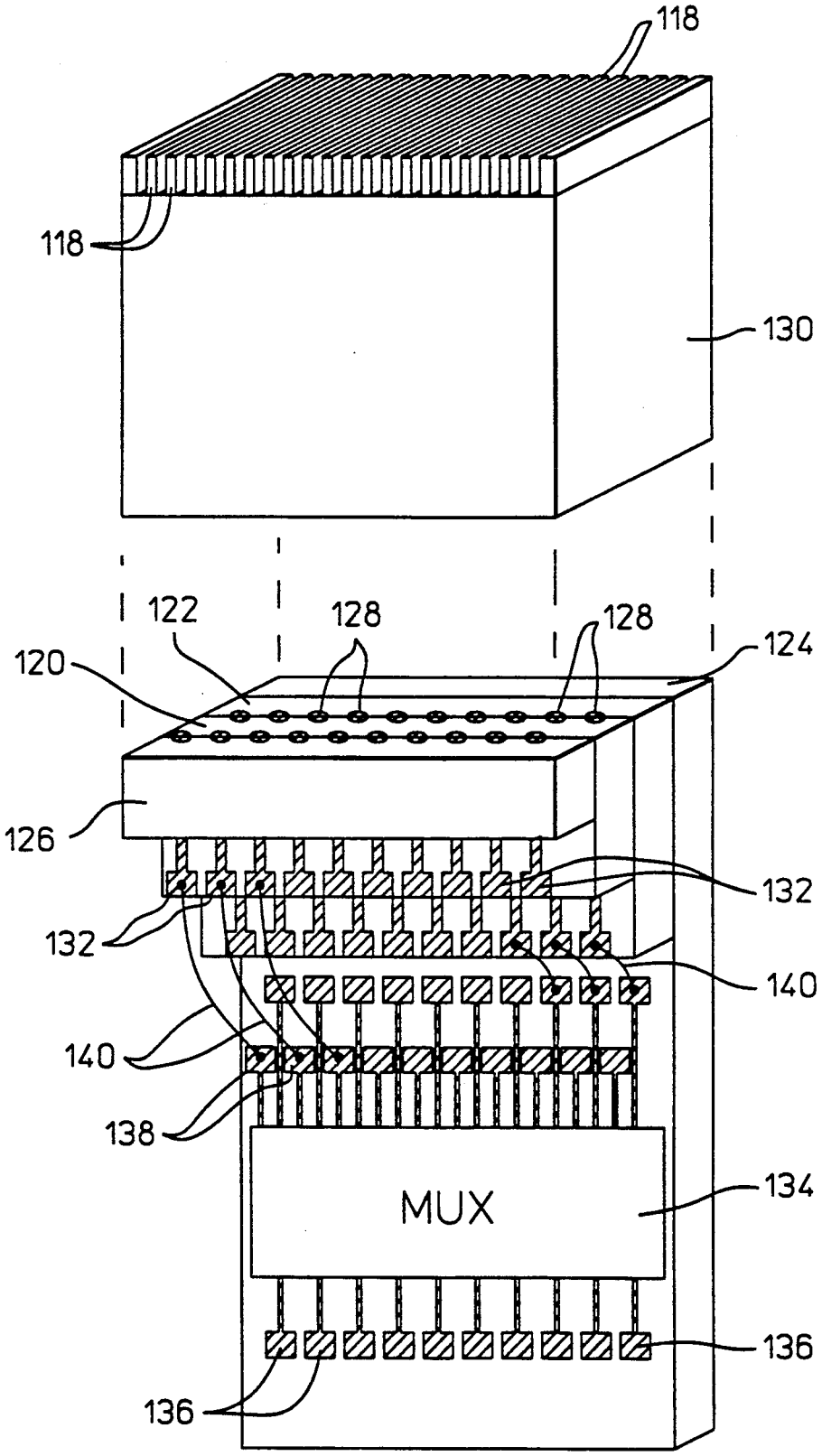
FIG. 9 is a perspective view of another embodiment of an acoustic transducer in accordance with the present invention.

Referring now to FIG. 9, circuits for conditioning signals to and from an array of piezoelectric elements 118 may have a pitch that exceeds the pitch of the piezoelectric elements. In such case, the circuits may be divided between two active integrated circuit chips 120 and 122 in an alternating manner. Spacer chips 124 and 126 sandwich the active chips 120 and 122. Contact pads 128 connect to a Z-axis backing member 130 for electrical communication between the piezoelectric elements 118 and input/output pads on the active chips.

In addition to the signal conditioning provided by circuits on the active chips 120 and 122, the lamination of chips may include a multiplexer 134. The multiplexer may be fabricated directly on the spacer chip 124, but may be a separate member that is attached to the chip. Input/output pads 136 to the multiplexer are connected to a cable. Pads 138 from the multiplexer are connected to the input/output pads of the active chips 120 and 122 by wire bonds 140. Flex circuits or tape automated bonding frames may be used in place of the wire bonds.

An on-board multiplexer 134 allows switching of the activated piezoelectric elements 118 at the end of a connector cable closest to the piezoelectric elements 118. Thus, a twenty-element piezoelectric array can be operated using a cable having only ten signal lines. If the multiplexer were located at the opposite end of the cable, typically the cable would require more than ten signal lines.

I claim:

1. An acoustic transducer for transmitting acoustic wave energy in response to an electrical signal and for converting received acoustic wave energy into an electrical signal comprising:

an array of piezoelectric elements, each having forward and rearward faces;

backing means attached at said rearward faces for attenuating acoustic wave energy received from said piezoelectric elements;

a lamination of parallel integrated circuit chips spaced apart form said piezoelectric elements by said backing means, said integrated circuit chips having opposed first and second major surfaces, adjacent integrated circuit chips in said lamination being fixed together at said major surfaces such that integrated circuit chips define layers in said lamination, said integrated circuit chips including signal-conditioning circuitry dedicated to said piezoelectric elements; and conductor means for electrically connecting said integrated circuit chips to said piezoelectric elements.

2. The transducer of claim 1 wherein circuitry dedicated to an individual piezoelectric element is within a spatial volume defined by a rearward projection of the rearward face of said individual piezoelectric element.

3. The transducer of claim 1 wherein said backing means is formed of acoustical attenuating material and wherein said conductor means includes a plurality of conductors having first ends in electrical contact with said piezoelectric elements and having second ends in electrical contact with said lamination of integrated circuit chips, said array of piezoelectric elements being a two-dimensional array.

4. The transducer of claim 3 wherein said conductors are linear conductive members extending through said acoustical attenuating material.

5. The transducer of claim 1 wherein said plurality of integrated circuit chips are coterminous at first edges to form a first planar contact face at said first edges, said first planar contact face having an array of contact pads in electrical communication with said conductor means.

6. The transducer of claim 5 wherein said plurality of integrated circuit chips are coterminous at second edges opposite to said first edges, thereby forming a second contact face, said second contact face having a pad grid array.

7. The transducer of claim 5 wherein said plurality of integrated circuit chips have second edges opposite to said first edges, said integrated circuit chips having non-uniform lengths such that said integrated circuit chips are non-coterminous at said second edges.

8. The transducer of claim 1 wherein each piezoelectric element is operatively associated with the identical signal-conditioning electrical circuit on one of said integrated circuit chips, said identical signal-conditioning electrical circuits being contained along parallel regions of said integrated circuit chip.

9. The transducer of claim 8 wherein said parallel regions have first and second ends, said first end of each parallel region having a contact pad in contact with said conductor means, and second end of each parallel region having an input/output pad.

10. An acoustic transducer comprising:

an array of transducer elements having forward and rearward faces;

a backing member having a plurality of conductors extending therethrough, said backing member coupled to said rearward faces of said transducer elements, said conductors having first ends exposed to achieve electrical contact with said transducer elements, said conductors having second ends at a side of said backing member opposite to said transducer elements, said backing member having an acoustic impedance to attenuate acoustic wave energy; and a plurality of parallel semiconductor members, each having contact pads at first edges, said plurality of semiconductor members having a laminate structure such that a surface of each of said semiconductor members is joined to a surface of another of said semiconductor members, said semiconductor members joined to said backing member such that said contact pads are aligned with said second ends of said conductors for electrical connection between said contact pads and said conductors, said semiconductor members having integrated circuitry for transmitting and receiving electrical signals to and from said transducer elements.

11. The transducer of claim 10 wherein said first edges of the semiconductor members are coterminous to form a planar contact surface, said contact pads being a two-dimensional pad grid array along said planar contact surface.

12. The transducer of claim 11 wherein said pad grid array, said conductors through said backing member and said transducer elements are all aligned.

13. The transducer of claim 10 wherein said backing member is a block having opposed first and second sides having two-dimensional pad grid arrays.

14. The transducer of claim 10 wherein said semiconductor members have integrated circuitry dedicated to each transducer element, wherein said integrated circuitry dedicated to a specified transducer element is within the acoustic shadow of said specified transducer element.

15. An acoustic transducer comprising:

a two-dimensional array of transducer elements, each transducer element having a rearward surface;

a backing means connected to said rearward surfaces of said transducer elements for attenuating acoustic wave energy;

conductor means for inputting and outputting electrical energy for operation of said transducer elements; and a plurality of rigid semiconductor chips for conditioning said electrical energy for operation of said transducer elements, said semiconductor chips being arranged in a plurality of layers to form a lamination thereof, each chip having a plurality of functionally similar integrated circuits, said integrated circuits having electrical connections in one-to-one correspondence with said transducer elements, each integrated circuit being within an acoustic shadow of a transducer element corresponding thereto, said acoustic shadow of a transducer element being a region defined as being within a rearward projection of said rearward surface of the transducer element and being beyond said backing means 16. The transducer of claim 15 wherein said semiconductor chips have parallel segments extending in a direction perpendicular to said rearward surfaces of said transducer elements, the integrated circuit electrically connected with a transducer element being within the parallel segment that is in the acoustic shadow of the transducer element.

17. The transducer of claim 15 wherein said integrated circuits include a preamplifier.

18. The transducer of claim 16 wherein said semiconductor chips are coterminous at first edges and have input/output pads at said first edges to form a first pad grid array, said first pad grid array being in electrical contact with said conductor means.

19. The transducer of claim 18 wherein said conductor means includes a second pad grid array disposed upon said backing means for contact with said semiconductor chips.

* * * * *